US010359172B2

(12) United States Patent
Shi

(10) Patent No.: US 10,359,172 B2
(45) Date of Patent: Jul. 23, 2019

(54) LED HEADLIGHT

(71) Applicant: SHENZHEN WELL-DONE INDUSTRIAL CO., LTD., Shenzhen (CN)

(72) Inventor: Guangming Shi, Shenzhen (CN)

(73) Assignee: WELL-DONE INDUSTRIAL CO., LTD., Shenzhen (CN)

( * ) Notice: Subject to any disclaimer, the term of this patent is extended or adjusted under 35 U.S.C. 154(b) by 0 days.

(21) Appl. No.: 16/007,991

(22) Filed: Jun. 13, 2018

(65) Prior Publication Data

US 2019/0128496 A1 May 2, 2019

(30) Foreign Application Priority Data

Oct. 27, 2017 (CN) ..... 2017 2 1411940 U
Feb. 27, 2018 (CN) ..... 2018 2 0278214 U

(51) Int. Cl.
*F21S 41/365* (2018.01)
*F21S 41/25* (2018.01)
(Continued)

(52) U.S. Cl.
CPC ..... *F21S 45/48* (2018.01); *F21S 41/143* (2018.01); *F21S 41/24* (2018.01); *F21S 45/43* (2018.01)

(58) Field of Classification Search
CPC .. F21S 45/48; F21S 41/24; F21S 45/43; F21S 41/143
See application file for complete search history.

(56) References Cited

U.S. PATENT DOCUMENTS 6,773,138 B2 * 8/2004 Coushaine ..... F21V 29/76 362/656
7,914,184 B2 * 3/2011 Liu ..... F21V 29/004 362/373

(Continued)

*Primary Examiner* — Tracie Y Green
(74) *Attorney, Agent, or Firm* — Raymond Y. Chan; David and Raymond Patent Firm

(57) ABSTRACT

An LED headlight includes a base plate and a heat sink, wherein the LED lamp bead arranged on the base plate, wherein the base plate is fastened on the heat absorption surface, wherein a light guide column is disposed on a luminous side of the LED lamp bead, wherein the light guide column has a light incident surface and a light emitting surface, wherein a reflection head is arranged at one end of the light guide column opposite the light incident surface, wherein the light emitting surface is arranged at an outer periphery wall of the one end of the light guide column corresponding to the reflection head, wherein the light incident surface is arranged towards the luminous side of the LED lamp bead, wherein a rear house is mounted on the assembly surface, wherein a concave first cavity is defined at one end surface of the rear house opposite the assembly surface, wherein a heat dissipation fan is arranged in the first cavity, wherein the air outlet side or the suction side of the heat dissipation fan faces the assembly surface, wherein an air flowing opening communicated with the first cavity is arranged at the rear house. Compared with the prior art, the present utility application achieves transmitting lights by the light guide column, which changes the direction and distribution of the lights, so as to achieve the same luminous position and light uniform distribution in 360°, wherein the service life and the heat dissipation are safer and more reliable.

15 Claims, 5 Drawing Sheets

(51) Int. Cl.

| | |
|---|---|
| ***F21S 45/48*** | (2018.01) |
| ***F21S 45/43*** | (2018.01) |
| ***F21S 41/143*** | (2018.01) |
| ***F21S 41/24*** | (2018.01) |

(56) References Cited

U.S. PATENT DOCUMENTS

| | | | | |
|---|---|---|---|---|
| D712,579 | S * | 9/2014 | Cen | D26/39 |
| 9,476,564 | B2 * | 10/2016 | Lai | F21V 29/51 |
| 10,161,589 | B2 * | 12/2018 | Chiu | F21S 41/143 |

* cited by examiner

LED HEADLIGHT

CROSS REFERENCE OF RELATED APPLICATION

This is a non-provisional application that claims the benefit of priority under 35 U.S.C. § 119 to a China application, application number CN2017214119405, filed Oct. 27, 2017, and the benefit of priority under 35 U.S.C. § 119 to a China application, application number CN2018202782149, filed Feb. 27, 2018.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT UTILITY APPLICATION

Field of the Present Utility Application

The present utility application relates to automotive lighting, and more particularly to an LED headlight.

Description of Related Arts

An LED (light-emitting diode) headlight has gradually been one of the common auto parts. Due to its low-power consumption, an LED gains more and more popularity among the car owners. Now, the structure of the LED headlight in the market is that a plurality of LED lamp beads is arranged on a side of a heat sink or a heat pipe, wherein the LED headlight directly lights from its side. But the structure of the LED headlight has the following problems: first, it is difficult for the LED headlight to achieve the same light effect like a traditional halogen lamp, wherein the traditional halogen lamp lights uniformly; second, the size of a luminous body of the LED headlight is large, which cannot be controlled within a reasonable specification range; third, the heat conduction distance of the LED headlight is long and the sectional area of a heat conduction body is small, which lead that the light type of the headlight refitting is unsatisfactory and dose not consistent with the regulatory requirements, wherein the LED headlight in the market also has serious heat condition and heat dissipation performance.

SUMMARY OF THE PRESENT UTILITY APPLICATION

In order to overcome the deficiencies of the prior art, the present utility application provides an LED headlight, which realizes the same luminous position and light distribution as a conventional halogen lamp without blind area and dark area, wherein the light can be seen from any angle, wherein the LED headlight is more efficient, wherein an LED heat source and a heat sink fit together without distance to achieve better heat dispersion, wherein the light utilization efficiency is high, wherein the structure is simple and the size of the LED headlight is small, wherein the passing rate of loading the LED headlight on the car is high.

Additional advantages and features of the utility application will become apparent from the description which follows, and may be realized by means of the instrumentalities and combinations particular point out in the appended claims.

In order to solve the above problems, the present utility application adopts the following technical solutions: an LED headlight comprises a base plate and a heat sink, wherein an LED lamp bead is arranged on the base plate, wherein the heat sink is constructed to be a column shape, wherein one end surface at one end of the heat sink forms a heat absorption surface, wherein an outer periphery wall of the heat sink forms a heat dissipation surface, and the other end surface at the other end of the heat sink forms an assembly surface, wherein the base plate is fastened on the heat absorption surface, wherein a light guide column is disposed on a luminous side of the LED lamp bead, wherein the light guide column has a light incident surface and a light emitting surface, wherein a reflection head is arranged at one end of the light guide column opposite to the light incident surface, wherein the light emitting surface is arranged at an outer periphery wall of the one end of the light guide column corresponding to the reflection head, wherein the reflection head is used to reflect the lights incoming from the light incident surface so that the lights can be emitted from the light emitting surface, wherein the light incident surface is arranged to face towards the luminous side of the LED lamp bead, wherein the light guide column and the heat sink are arranged along a same axis, wherein a rear house is mounted on the assembly surface, wherein a concave first cavity is defined at one end surface of the rear house opposite to the assembly surface, wherein a heat dissipation fan is arranged in the first cavity, wherein an air outlet side or an suction side of the heat dissipation fan faces the assembly surface, wherein an air flowing opening communicated with the first cavity is defined at the rear house, wherein the heat sink conducts heat absorbed by the heat absorption surface to the heat dissipation surface and promotes the air flow in an air guiding passage to take hear away by the heat dissipation fan.

Further, a plurality of heat dissipation fins is arranged on the heat dissipation surface, wherein the heat dissipation fins are circumferentially distributed around the heat sink in an array, wherein the air guiding passage is formed between the two adjacent heat dissipation fins, wherein each of the air guiding passages is arranged towards the air flowing opening.

Further, the heat dissipation fins comprises a plurality of main fins, wherein the main fins are circumferentially distributed around the heat sink in an array and connect to the heat dissipation surface.

Further, the heat dissipation fins comprises a plurality of first sub-fins, wherein the first sub-fins are symmetrically arranged on the two sides of the main fins at the air guiding passage.

Further, the heat dissipation fins comprises a plurality of second sub-fins, wherein the second sub-fins are disposed at a side edge of the main fins away from the heat dissipation surface.

Further, the heat sink joints with the light guide column by a light guide column fixation ring, wherein the light guide column fixation ring has an inner hole, wherein the light guide column protrudes out of the light guide column fixation ring through the inner hole, wherein an internal thread is provided on the hole wall of the inner hole, wherein an external thread is arranged on the heat dissipation surface locating at the heat absorption surface of the heat sink, wherein the light guide column fixation ring is fixed by the connection between the internal thread in the inner hole and the external thread at the heat sink.

Further, a hold seat is arranged between the light guide column fixation ring and the heat sink, wherein the hold seat rings between the light guide column fixation ring and the heat sink.

Further, a silica gel ring is set between the hold seat and the heat sink.

Further, a connection board is assigned between the heat dissipation fan and the heat sink, wherein the connection board respectively connects with the wires of the heat dissipation fan and the wires of base plate.

Further, the section of the lower part of the reflection head is a conical reflection-surface structure, wherein the higher part of the reflection head is a facet structure, wherein the conical reflection-surface structure is used to reflect the lights entering the light guide column, wherein the facet structure is used for heat dissipation, wherein a groove adapted to the conical reflection-surface structure is arranged at the one end of the light guide column opposite to the light incident surface, wherein the conical reflection-surface structure is received in the groove.

Compared with the prior art, the present utility application directly arranges the LED lamp bead and the base plate on the one end surface at one end of the heat sink, which achieves transmitting lights by the light guide column, which changes the direction and distribution of the lights, instead of the traditional LED headlights which arranges the LED lamp bead on a side of the heat sink or a heat pipe to light directly from its side, so as to achieve the same luminous position and light uniform distribution in 360° as a conventional halogen lamp. Secondly, it relieves the design bottleneck between the thermal conduction distance, the cross-sectional area of the thermal conductor and the heat dissipation to arrange the LED lamp bead and the base plate on the one end surface of the heat sink, so that the lights of the headlights after refitting meet the regulation more, wherein the service life and the heat dissipation are safer and more reliable. Furthermore, the structure of the LED headlights according to the present utility application is simple and its volume is small, wherein the passing rate of loading the LED headlight on the car is high.

Still further objects and advantages will become apparent from a consideration of the ensuing description and drawings.

These and other objectives, features, and advantages of the present utility application will become apparent from the following detailed description, the accompanying drawings, and the appended claims.

DETAILED DESCRIPTION OF THE PREFERRED EMBODIMENT

The following description is disclosed to enable any person skilled in the art to make and use the present utility application. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present utility application.

The present utility application will be further described in detail with reference to the drawings and embodiments.

Figure 1:
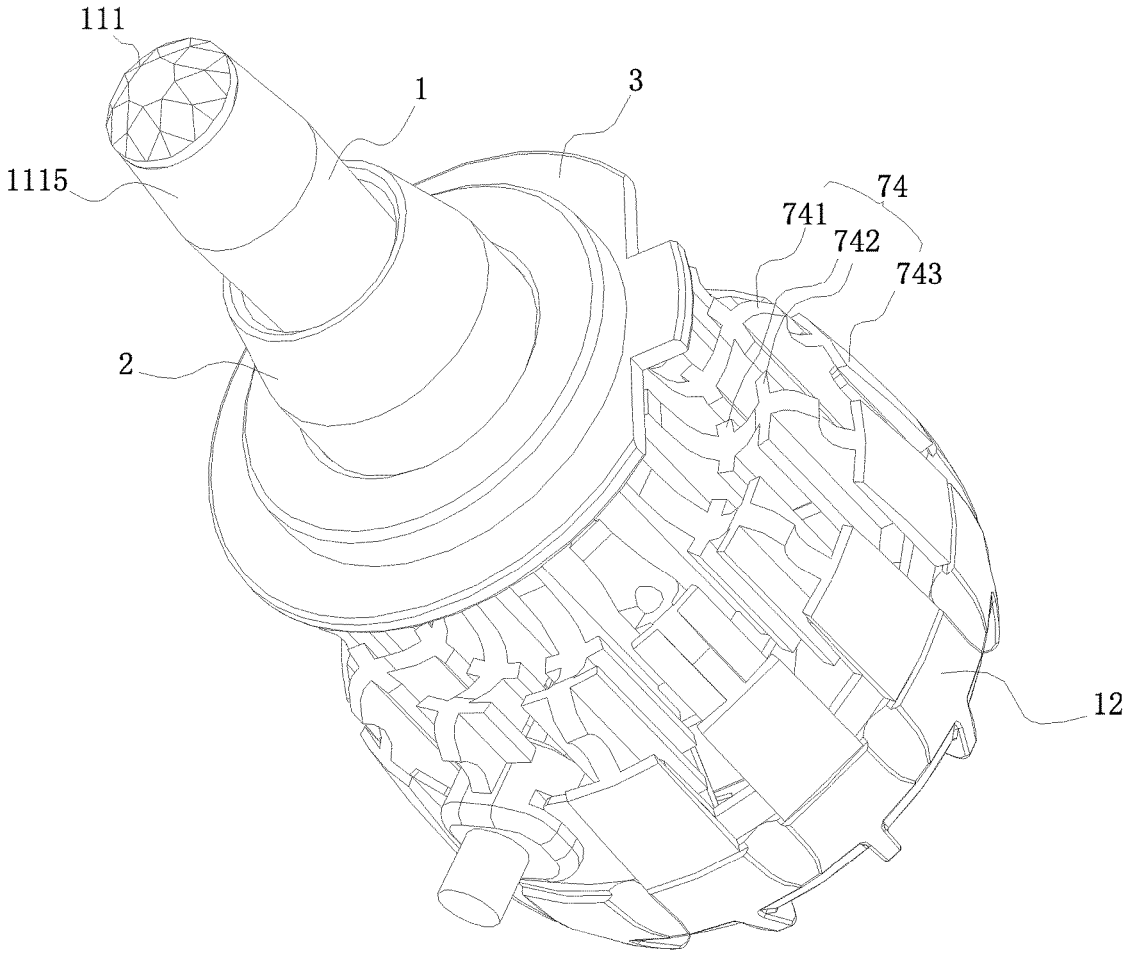
FIG. 1 is a schematic view of the external structure according to the present utility application.
Figure 2:
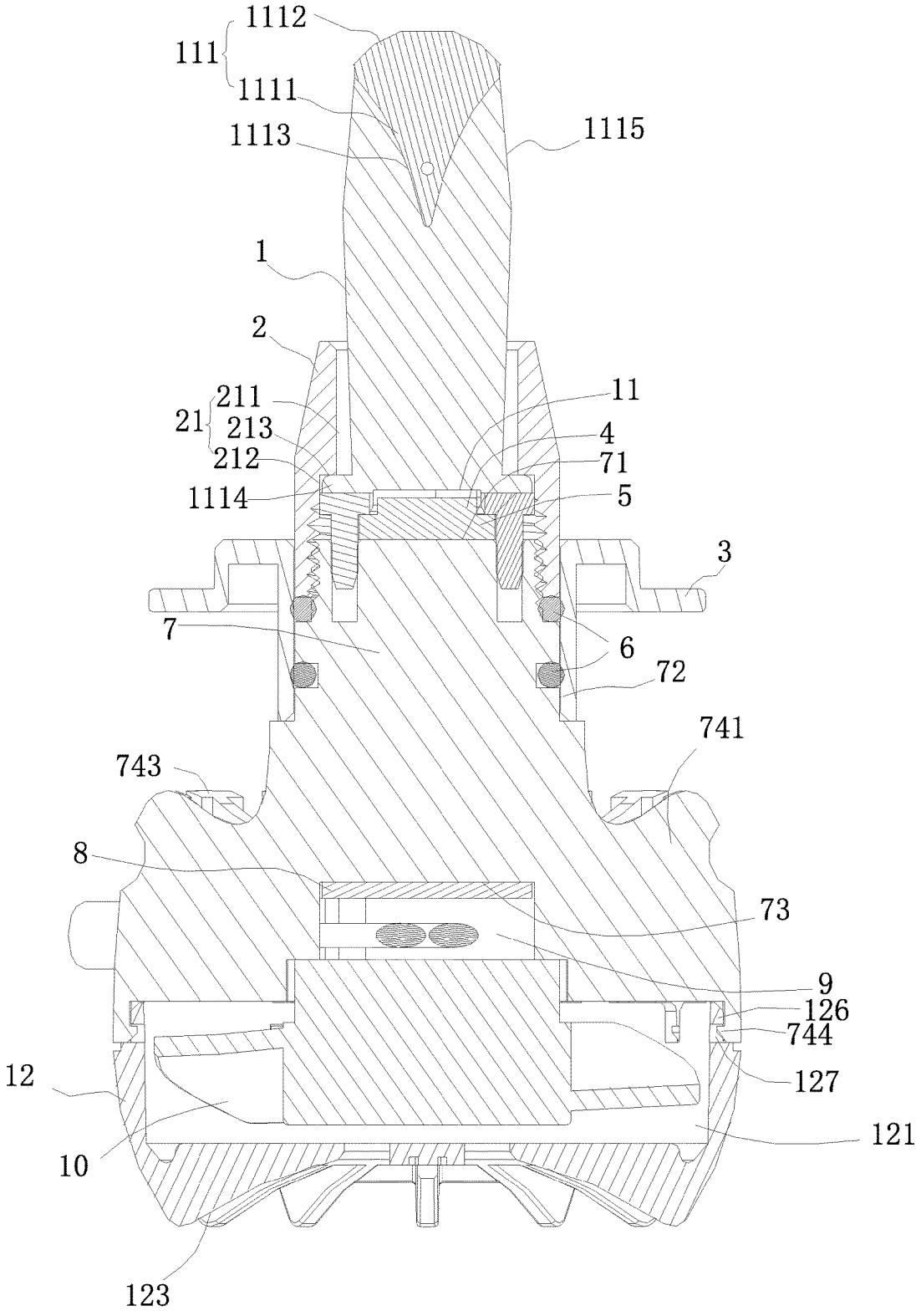
FIG. 2 is a schematic view of the internal structure according to the present utility application.

Referring to FIG. 1 and FIG. 2 of the drawings, an LED headlight according to the present utility application comprises a base plate 5 and a heat sink 7, wherein an LED lamp bead 4 is arranged on the base plate 5, wherein the heat sink 7 is constructed to be a column shape, wherein the heat sink 7 has two end surfaces, wherein one end surface forms a heat absorption surface 71, wherein the other end surface of the heat sink 7 forms an assembly surface 73, and an outer periphery wall of the heat sink 7 forms a heat dissipation surface 72, wherein the base plate 5 is fastened on the heat absorption surface 71, wherein a light guide column 1 is arranged on a luminous side of the LED lamp bead 4, wherein the light guide column 1 has a light incident surface 11 and a light emitting surface 1115, wherein the light incident surface 11 is arranged towards the luminous side of the LED lamp bead 4, wherein a reflection head 111 is arranged at one end of light guide column 1 opposite to the light incident surface, wherein the light emitting surface 1115 is arranged at an outer periphery wall of the light guide column 1, wherein the outer periphery wall is a side of the light guide column 1 towards the reflection head 111, wherein the reflection head 111 is used to reflect the lights incoming from the light incident surface 11 and the lights can be emitted from the light emitting surface 1115, wherein the light guide column 1 and the heat sink 7 are arranged along a same axis, wherein a rear house 12 is mounted on the assembly surface 73, wherein a concave first cavity 121 is defined at one end surface of the rear house 12 opposite to the assembly surface 73, wherein a heat dissipation fan 10 is arranged in the first cavity 121, wherein the cross-sectional shape of the first cavity 121 is adapted to an external shape of the heat dissipation fan 10, wherein an air outlet side or a suction side of the heat dissipation fan 10 faces the assembly surface so as to take away the heat of the heat sink 7 better, wherein an air flowing opening 122 communicated with the first cavity 121 is formed at the rear house 12, wherein the heat sink 7 conducts the heat absorbed by the heat absorption surface 71 to the heat dissipation surface 72, and strengthens heat extraction and heat dissipation by the heat dissipation fan 10, wherein a connection board 8 is arranged between the heat dissipation fan 10 and the heat sink 7, wherein the connection board 8 respectively connects the heat dissipation fan 10 and the base plate 5 by a plurality of wires, wherein the connection board 8 is arranged towards the assembly surface 73, wherein the connection board 8 here is a circuit board which provides connection and welding for each of the wires.

According to the present utility application, the light emitting surface 1115 is arranged as the outer periphery wall of the end of the light guide column 1 towards the reflection head 111, thereby emitting the lights from the light emitting surface 1115 around the circumference of the light emitting surface 1115 after the lights reflected by the reflection head 11, wherein the lights emitted here may be perpendicular to an axis of the light guide column 1 or not.

In the structure above, an emitting side-luminance mode is changed to emit lights on the front of the heat sink 7, wherein it avoids the problem of uneven luminance and dark area of a traditional light emitting structure to convert the lights to radiate along the circumferential direction of the light guide column by the light emitting surface 1115 of the light guide column 1 and the reflection head 11, wherein the distance of heat conduction can be shortened and the cross-sectional area of a thermal conductor can be lager to improve heat dissipation at the same time.

According to the FIG. 1 and FIG. 2, the section shape of a lower portion of the reflection head 11 is a conical reflection-surface structure 1111, wherein a higher portion of the reflection head 11 is a facet structure 1112, wherein the conical reflection-surface structure 1111 is used to reflect the lights into the light guide column 1, wherein the facet structure 1112 is used for heat dissipation, wherein a groove 1113 adapted to the conical reflection-surface structure 1111 is arranged at the other end of the light guide column 1 opposite to the light incident surface 11, wherein the conical reflection-surface structure 1111 is arranged in the groove 1113, thereby leading to the conical reflection-surface structure 1111 corresponding to the light emitting surface 1115, wherein the conical reflection-surface structure 1111 and the light guide column 1 are integrally formed by two-shot molding. The facet in the facet structure 1112 can be understood as a micro type or a burnishing type, which means that the outer contour is a polyhedron surrounded by several small and flat sides, which can be also called an polishing, wherein the facet generally refers to each burnishing surface of a facet gemstone different in shapes, sizes and positions, wherein the present utility application arranging the higher portion of the reflection head 11 as the facet structure is convenient to dissipate heat.

Figure 3:
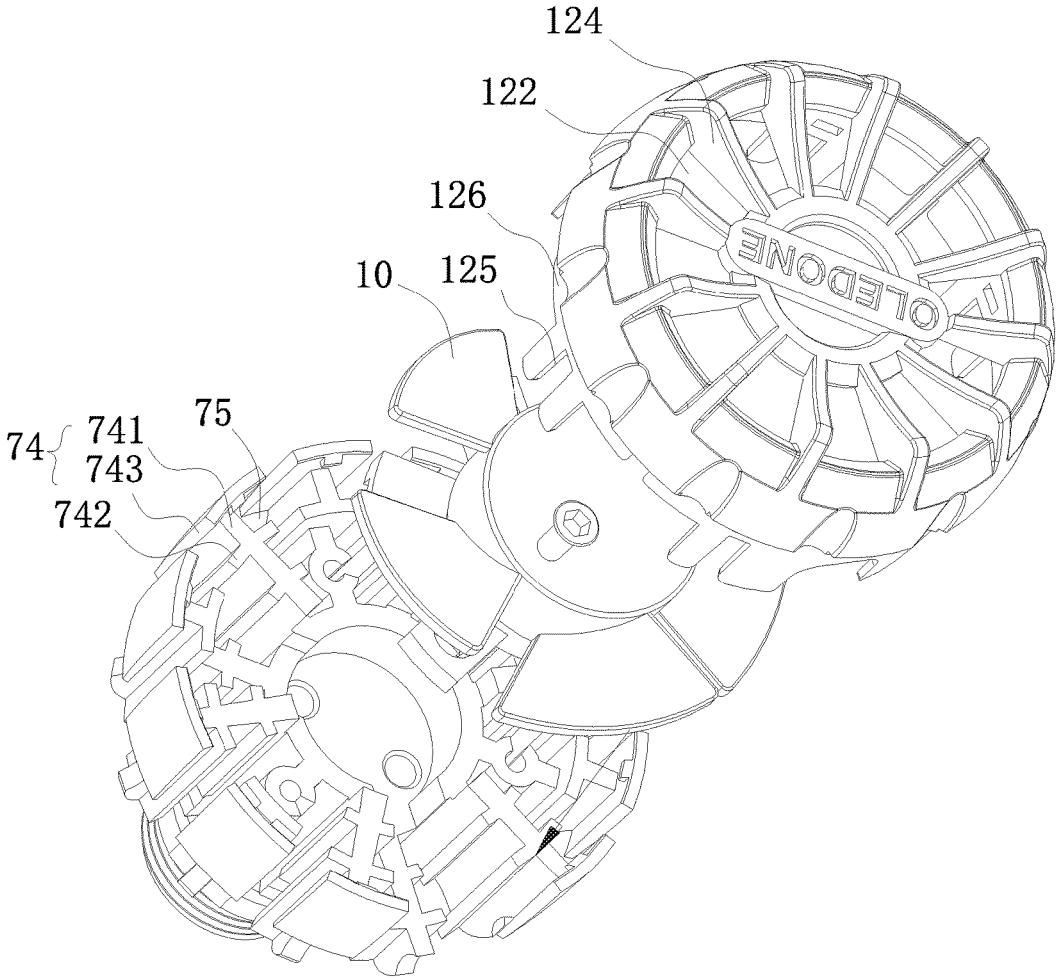
FIG. 3 is an assembly schematic view of a heat sink, a rear house and a heat dissipation fan according to the present utility application.
Figure 4:
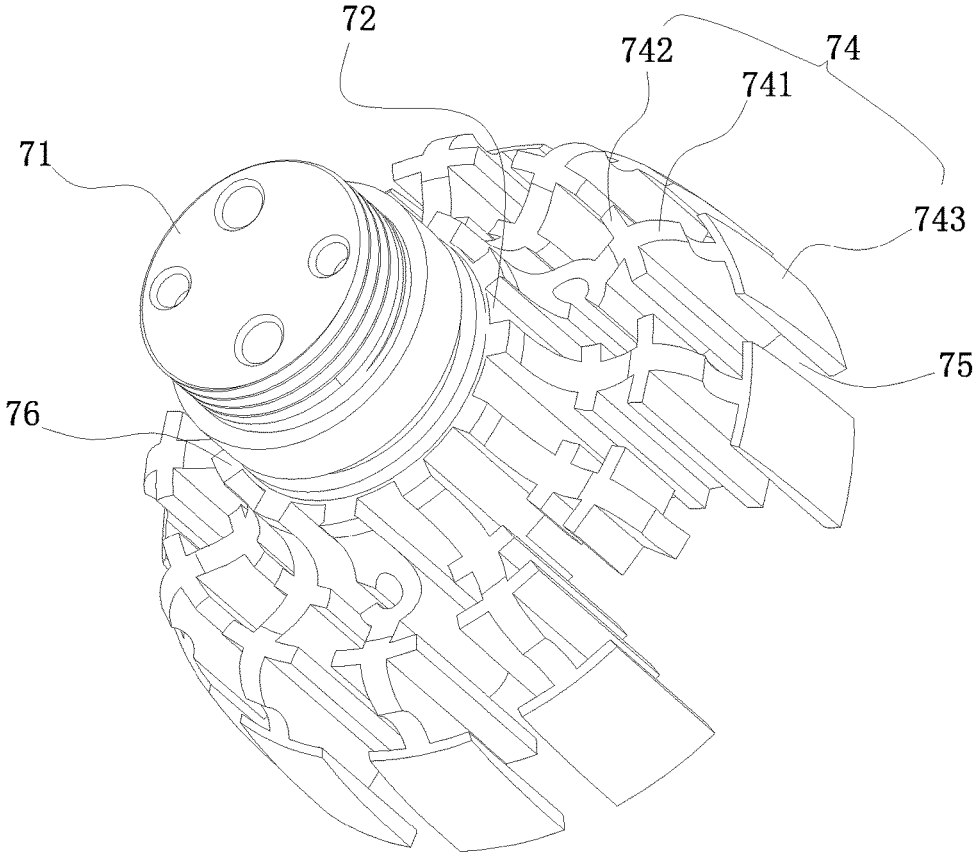
FIG. 4 is a schematic view of the structure of the heat sink according to the present utility application.
Figure 5:
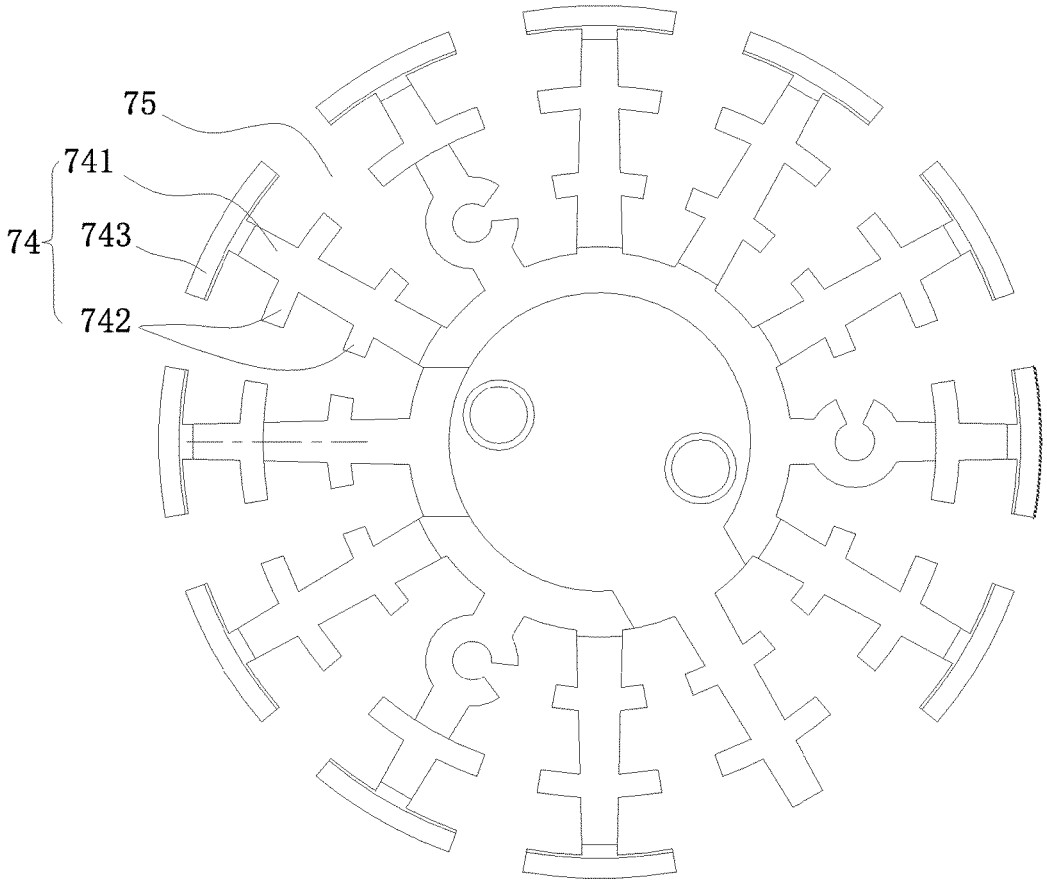
FIG. 5 is a sectional view of the heat sink according to the present utility application.

Shown as the FIG. 3, FIG. 4 and FIG. 5, a plurality of heat dissipation fins 74 is arranged on the heat dissipation surface 72, wherein a second cavity 9 is formed at one end of the heat dissipation fins 74 corresponding to the first cavity 121, and the second cavity 9 locates at the assembly surface 73 (shown as the FIG. 2), wherein the first cavity 121 provides an accommodating room for the heat dissipation fan 10, wherein the second cavity 9 provides an receiving room for the connection board 8. The heat dissipation fins 74 are circumferentially distributed around the heat sink 7 in an array, wherein an air guiding passage 75 is formed between the two adjacent heat dissipation fins 74, wherein each of the air guiding passages 75 is opposite to the at least one air flowing opening 122 so as to conduct out the heat and shorten the time of heat dissipation, wherein the heat dissipation fan 10 is fastened at the heat dissipation fins 74 by a screw lock.

According to FIG. 2, a plurality of heat dissipation fins 74 are arranged around an periphery of the heat dissipation surface 72 and distributed evenly.

According to FIG. 3, FIG. 4 and FIG. 5, the heat dissipation fins 74 comprises a plurality of main fins 741, wherein the main fins 741 are circumferentially distributed around the heat sink 7 in an array and connect to the heat dissipation surface 72.

According to FIG. 3, FIG. 4 and FIG. 5, the heat dissipation fins 74 further comprises a plurality of first sub-fins 742, wherein the first sub-fins 742 are symmetrically arranged on the two sides of the main fins 741 at the air guiding passage 75, wherein the two first sub-fins 742 are respectively perpendicular to the two sides of the main fins 741, wherein the two first sub-fins 742 are arranged along the length of the main fins 741, wherein the width of the first sub-fins 742 close to the heat dissipation surface 72 is smaller than the width of the first sub-fins 742 away from the heat dissipation surface 72. It increases the effect of heat dissipation to increase the branches for heat dissipation.

Certainly, the heat dissipation fins 74 according to the present utility application further comprises a plurality of second sub-fins 743 (shown in FIG. 5), wherein the second sub-fins 743 are disposed at a side edge of the main fins 741 away from the heat dissipation surface 72, wherein the second sub-fins 743 are parallel to the first sub-fins 742 and arranged along the length of the main fins 741, wherein it's worth noting that the width of the second sub-fins 743 is larger than the width of the first sub-fins 742, wherein the two adjacent second sub-fins 743 are not in contact with each other.

As shown in FIG. 2, the outer size and shape of the section of the rear house 12 are adapted to the outer size and shape of the section of the heat dissipation fins 74.

According to FIG. 1, FIG. 2 and FIG. 3, the air flowing opening 122 is distributed at an end surface 123 of the rear house 12 which is opposite to the heat dissipation fan 10, thereby forming a straight passage between the air flowing opening 122 and the heat dissipation fan 10, wherein a division component 124 between the two adjacent air flowing openings 122 is an elongated strip, wherein the air flowing opening 122 is radially arranged along the end surface 123, wherein one end of the each division component 124 is directed to the center of the end surface 123 which increases the air intake.

Referring to FIG. 1 and FIG. 2, a light guide column fixation ring 2 is further arranged between the heat sink 7 and the light guide column 1 to joint the two latter, wherein the a light guide column fixation ring 2 has an inner hole 21, wherein a light guide column fixation ring 2 rings on the heat sink 7, wherein the light guide column 1 protrudes out of the light guide column fixation ring 2 through the inner hole 21, wherein an against component 1114 is assigned at the periphery of one end of the light guide column 1 at the light incident surface 11, wherein an internal thread is provided on the hole wall of the inner hole 21, wherein an external thread is arranged the periphery of one end of the heat sink 7 at the heat absorption surface 71, wherein the light guide column fixation ring 2 is fixed by the connection between the internal thread in the inner hole and the external thread at the heat sink 7.

Referring to FIG. 2, the inner hole 21 comprises an extending hole 211 for the light guide column 1 extending and a connection hole 212 for connecting the heat sink 7, wherein the diameter of the connection hole 212 is lager than the diameter of extending hole 211 to form a stair side 213 within the extending hole 211 and the connection hole 212, wherein the internal thread is provided on the hole wall of the connection hole 212, wherein the stair side 213 abuts against the edge of the against component 1114 of the light guide column 1, after the light guide column fixation ring 2 connecting the heat sink 7 with thread so as to fasten the light guide column 1 and the light guide column fixation ring 2 at the same time.

Referring to FIG. 1 and FIG. 2, a hold seat 3 is arranged between the light guide column fixation ring 2 and the heat sink 7, wherein the hold seat 3 rings between the light guide column fixation ring 2 and the heat sink 7, wherein the rear end of the hold seat 3 is against on the main fins 741.

Referring to FIG. 2, a silica gel ring 6 is set between the hold seat 3 and the heat sink 7 used to increase friction for fixation. Of course, the silica gel ring 6 can also be arranged at the junction of the light guide column fixation ring 2 and the heat dissipation surface 72.

Referring to FIG. 2, a protrude edge 126 is arranged at one end edge of the rear house 12 opposite to the heat sink 7, wherein the protrude edge 126 is adapted to an assembly room formed by the second sub-fins 743, wherein a snap hole 127 is arranged at the protrude edge 126, wherein a snap joint component 744 is arranged at the second sub-fins 743 corresponding to the position of the snap hole 127, wherein a rear house 12 is fastened to the heat sink 7 by clamping the snap joint component 744 and the snap hole 127.

Referring to FIG. 3, a plurality of block grooves 125 are arranged on the protrude edge 126, wherein the block grooves 125 jam the main fins 741 to further ensure the stable connection with the heat sink 7.

Referring to FIG. 4 and FIG. 5, the second sub-fins 743 may not be provided on one of the main fins 741, which is used for the wires.

The present utility application directly arranges the LED lamp bead and the base plate on the one end surface of the heat sink, and achieves transmitting lights by the light guide column, which change the direction and distribution of the lights, instead of the traditional LED headlights which arrange the LED lamp bead on the side of the heat sink or the heat pipe to light directly from its side, so as to achieve the same luminous position and light uniform distribution in 360° without the blind area and dark area as a conventional halogen lamp, wherein the lights can be seen from any angle. Secondly, it achieves better heat dissipation to arrange the LED lamp bead and the base plate on the one end surface of the heat sink which means the LED heat source and the heat sink fit together without distance, thereby relieving the design bottleneck of the heat conduction and heat dissipation of the LED headlight. So that the lights of the headlights after refitting meet the regulation more, wherein the service life and the heat dissipation are safer and more reliable. Furthermore, the structure of the LED headlights according to the present utility application is simple and its volume is small, wherein the passing rate of loading the LED headlight on the car is high, thereby popularizing easily.

One skilled in the art will understand that the embodiment of the present utility application as shown in the drawings and described above is exemplary only and not intended to be limiting.

It will thus be seen that the objects of the present utility application have been fully and effectively accomplished. The embodiments have been shown and described for the purposes of illustrating the functional and structural principles of the present utility application and is subject to change without departure from such principles. Therefore, this utility application includes all modifications encompassed within the spirit and scope of the following claims.

What is claimed is:

1. An LED headlight, comprising a base plate;

a heat sink;

an LED lamp bead arranged on said base plate, wherein said heat sink is constructed to be a column shape, wherein one end surface of said heat sink forms a heat absorption surface, wherein an outer periphery wall of said heat sink forms a heat dissipation surface, and the other end surface of said heat sink forms an assembly surface, wherein said base plate is fastened on said heat absorption surface;

a light guide column disposed on a luminous side of said LED lamp bead, wherein said light guide column has a light incident surface and a light emitting surface;

a reflection head arranged at one end of said light guide column which is opposite to said light incident surface, wherein said light emitting surface is arranged at the outer periphery wall of said one end of said light guide column corresponding to said reflection head, wherein said reflection head is used to reflect the lights incoming from said light incident surface and the lights will be emitted from said light emitting surface, wherein said light incident surface is arranged to face towards said luminous side of said LED lamp bead, wherein said light guide column and said heat sink are arranged along a same axis;

a rear house mounted on said assembly surface, wherein a concave first cavity is defined at one end surface of said rear house opposite to said assembly surface; and a heat dissipation fan arranged in said first cavity, wherein one of an air outlet side and a suction side of said heat dissipation fan faces said assembly surface, wherein an air flowing opening communicated with said first cavity is defined at said rear house, wherein said heat sink conducts heat absorbed by said heat absorption surface to said heat dissipation surface and promotes the air flow to take heat away by said heat dissipation fan.

2. The LED headlight as recited in claim 1, further comprises a plurality of heat dissipation fins arranged on said heat dissipation surface, wherein said heat dissipation fins are distributed around said heat sink in a circumferential array, wherein an air guiding passage is formed between two said adjacent heat dissipation fins, wherein each of said air guiding passages is arranged towards said air flowing opening.

3. The LED headlight as recited in claim 2, wherein said heat dissipation fins comprises a plurality of main fins, wherein said main fins are distributed around said heat sink in a circumferential array and connect to said heat dissipation surface.

4. The LED headlight as recited in claim 3, wherein said heat dissipation fins comprises a plurality of first sub-fins, wherein said first sub-fins are symmetrically arranged on the two sides of said main fins at said air guiding passage.

5. The LED headlight as recited in claim 3, wherein said heat dissipation fins comprises a plurality of second sub-fins, wherein said second sub-fins are disposed at a side edge of said main fins away from said heat dissipation surface.

6. The LED headlight as recited in claim 1, wherein said heat sink joints with said light guide column by a light guide column fixation ring, wherein said light guide column fixation ring has an inner hole, wherein said light guide column protrudes out of said light guide column fixation ring through said inner hole, wherein an internal thread is provided on a hole wall of said inner hole, wherein an external thread is arranged on said heat dissipation surface locating at said heat absorption surface of said heat sink, wherein said light guide column fixation ring is fixed by the connection between said internal thread in said inner hole and said external thread at said heat sink.

7. The LED headlight as recited in claim 2, wherein said heat sink joints with said light guide column by a light guide column fixation ring, wherein said light guide column fixation ring has an inner hole, wherein said light guide column protrudes out of said light guide column fixation ring through said inner hole, wherein an internal thread is provided on a hole wall of said inner hole, wherein an external thread is arranged on said heat dissipation surface locating at said heat absorption surface of said heat sink, wherein said light guide column fixation ring is fixed by the connection between said internal thread in said inner hole and said external thread at said heat sink.

8. The LED headlight as recited in claim 6, wherein a hold seat is arranged between said light guide column fixation ring and said heat sink, wherein said hold seat rings between said light guide column fixation ring and said heat sink.

9. The LED headlight as recited in claim 8, wherein a silica gel ring is arranged between said hold seat and said heat sink.

10. The LED headlight as recited in claim 7, wherein a hold seat is arranged between said light guide column fixation ring and said heat sink, wherein said hold seat rings between said light guide column fixation ring and said heat sink.

11. The LED headlight as recited in claim 10, wherein a silica gel ring is arranged between said hold seat and said heat sink.

12. The LED headlight as recited in claim 1, wherein a connection board is assigned between said heat dissipation fan and said heat sink, wherein said connection board respectively connects with a plurality of wires of said heat dissipation fan and a plurality of wires of base plate.

13. The LED headlight as recited in claim 2, wherein a connection board is assigned between said heat dissipation fan and said heat sink, wherein said connection board respectively connects with a plurality of wires of said heat dissipation fan and a plurality of wires of base plate.

14. The LED headlight as recited in claim 1, wherein the section of a lower part of said reflection head is a conical reflection-surface structure, wherein a higher part of said reflection head is a facet structure, wherein said conical reflection-surface structure is used to reflect the lights entering said light guide column, wherein said facet structure is used for heat dissipation, wherein a groove adapted to said conical reflection-surface structure is arranged at the one end of said light guide column opposite to said light incident surface, wherein said conical reflection-surface structure is received in said groove.

15. The LED headlight as recited in claim 2, wherein the section of a lower part of said reflection head is a conical reflection-surface structure, wherein a higher part of said reflection head (is a facet structure, wherein said conical reflection-surface structure is used to reflect said lights entering said light guide column, wherein said facet structure is used for heat dissipation, wherein a groove adapted to said conical reflection-surface structure is arranged at the one end of said light guide column opposite to said light incident surface, wherein said conical reflection-surface structure is received in said groove.

* * * * *